United States Patent [19]

Tarutani et al.

[11] 4,360,381

[45] Nov. 23, 1982

[54] FERRITIC STAINLESS STEEL HAVING GOOD CORROSION RESISTANCE

[75] Inventors: Yoshio Tarutani, Minoo; Taishi Moroishi, Kobe; Masao Koike, Nishinomiya, all of Japan

[73] Assignees: Sumitomo Metal Industries, Ltd., Osaka; Nippon Stainless Steel Co., Ltd., Tokyo, both of Japan

[21] Appl. No.: 251,771

[22] Filed: Apr. 7, 1981

[30] Foreign Application Priority Data

Apr. 11, 1980 [JP] Japan ..... 55/47678
Feb. 13, 1981 [JP] Japan ..... 56/19658

[51] Int. Cl.[3] ..... C22C 38/26

[52] U.S. Cl. ..... 75/126 F; 75/128 G; 148/12 EA

[58] Field of Search ..... 75/126 F; 148/12 EA, 148/128 G

[56] References Cited

U.S. PATENT DOCUMENTS 3,957,544 5/1976 Pinnow et al. ..... 75/126 F
3,963,532 6/1976 Demo, Jr. ..... 75/126 F

FOREIGN PATENT DOCUMENTS 50-4166 2/1975 Japan ..... 75/126 F
55-91944 7/1980 Japan ..... 148/12 EA

OTHER PUBLICATIONS

Janik-Czachor et al., "Effect of Sulfur and Manganese on Nucleation of Corrosion Pits in Iron", Br. Corros. J, 1972, vol. 7, Mar., pp. 90-93.

Uhlig, *Corrosion and Corrosion Control,* John Wiley & Sons, Inc., 1971, pp. 307-311, 296, 297.

*Primary Examiner*—Peter K. Skiff

*Attorney, Agent, or Firm*—Burns, Doane, Swecker & Mathis

[57] ABSTRACT

A 10-35% Cr ferritic stainless steel stabilized with 0.20-1.00% of Nb wherein Nb%≧(8×C%+2.0%) with impurities, such as carbon, nitrogen, phosphorous, oxygen and sulfur reduced to given levels is disclosed. By reducing the sulfur content to a level of not greater than 0.002%, preferably less than 0.001% or in cases where copper and/or nickel is added, to a level of not greater than 0.005%, the corrosion resistance of the resulting steel can markedly be improved. Since the ferritic stainless steel of this invention also exhibits a combination of good surface appearance and formability, it can be substituted for certain austenitic stainless steels not only as a general corrosion resistant material, but also as a material for making external automotive trims and so on.

25 Claims, 5 Drawing Figures

FERRITIC STAINLESS STEEL HAVING GOOD CORROSION RESISTANCE

BACKGROUND OF THE INVENTION

This invention relates to ferritic stainless steels exhibiting markedly improved corrosion resistance to rust and acids.

In general, ferritic stainless steel has been widely used as a corrosion resistance material because it is inexpensive due to the lack of incorporation of nickel (a relatively expense alloying element) and because it exhibits improved resistance to stress-corrosion cracking. However, ferritic stainless steel is inferior to austenitic stainless steel with respect to the resistance to rust, particularly under environments containing chloride ions, and the resistance to acids. This tendency is pronounced on low-Cr ferritic stainless steels containing less than 18% Cr. Generally, nickel is incorporated into such steels to enhance their corrosion resistance. However, if a relatively large amount of nickel is incorporated in a ferritic stainless steel, the resistance to stress-corrosion cracking deteriorates and increase in material cost is unavoidable. It is to be noted that the resistance to stress-corrosion cracking is one of important properties of ferritic stainless steel.

Hitherto, in order to improve the corrosion resistance of ferritic stainless steel it has been proposed to increase the chromium content, to add molybdenum, to reduce the carbon or nitrogen content, or to add stabilizing elements, such as titanium, zirconium and niobium. For example, Japanese Patent Publication No. 5973/1975 discloses a pitting corrosion resistant ferritic stainless steel containing 22–30% Cr and 1.5–3% Mo with the addition of titanium and/or zirconium, and optionally niobium. Japanese Patent Publication No. 13464/1976 discloses a weatherable ferritic stainless steel containing 15–20% Cr and 0.3–1.5% Mo with the content each of carbon and nitrogen being reduced to less than 0.30% and with the addition of zirconium. U.S. Pat. No. 3,807,991 discloses a ferritic stainless steel containing 20.0–35.0% Cr and 0.75–1.20% Mo with the amounts of phosphorous, sulfur, carbon, and nitrogen being restricted to less than given levels, respectively, together with the addition of niobium. All these steels essentially contain molybdenum as well as a stabilizing element such as titanium, zirconium or niobium so as to improve the corrosion resistance. Thus, it is well known in the art that the addition of molybdenum can serve to improve the corrosion resistance, particularly the pitting resistance, of ferritic stainless steel. However, since molybdenum is not only expensive, but also is sharply fluctuating in prices, the molybdenum-containing steel material is not suitable as a material for manufacturing mass-production articles, such as automotive components. In addition, of the above stabilizing elements, titanium and zirconium easily form carbo-nitrides, oxides, etc. thereof with the resulting non-metallic inclusions causing surface defects such as are called "streak flaws" and "white cloudy appearance" when the steel is rolled to a thin sheet. The term "streak flaws" used herein means streak-like defects on the sheet surface caused by the inclusions of carbo-nitrides, etc., which have been extended in the rolling direction during rolling, and the term "white cloudy appearance" means that the metallic luster of the surface has been lost locally or throughout the surface thereof during pickling due to unusual corrosion of said inclusions which have been dispersed in the sheet surface area.

Furthermore, there is another approach to improve the corrosion resistance of ferritic stainless steel. That is, as is already known in the art, the sulfur content is reduced so as to further improve the corrsion resistance, since the presence of sulfur in steel adversely affects the corrosion resistance. For example, "Br. Corros. J." 1972, Vol. 7, March, pp. 90–93 discusses the effect of sulfur and manganese on the pitting corrosion of iron. "Scandinavian Journal of Metallurgy" 5(1976) pp. 16–20 reveals the correlation between the formation of pits and the sulfur content on austenitic stainless steel. In addition, the preprint report to a symposium held by the Japan Academy of Metallurgy (Nov. 15, 1978) pp. 11–15 discloses the effect of sulfur on pitting corrosion and interstitial corrosion. However, all these reports are merely based on the study of the influence of a sulfur content of around 0.003% at the lowest, and as disclosed in FIG. 1 on page 11 of said preprint report it has been concluded that a sulfur content of less than 0.006% does not provide any more substantial effect on the corrosion resistance than a sulfur content of 0.006%. That is, the effect of reducing the sulfur content is flat at a sulfur level of approximately 0.006%. In this connection, it has heretofore been thought in the art that a stainless steel having an extremely low sulfur content such as 0.001% or less is very difficult to put into practical use because of restrictions on the steel refining technology. In fact, the smallest sulfur content exemplified in said U.S. Pat. No. 3,807,991, for example, is only 0.007%, though it suggests that the sulfur content should be kept low.

OBJECTS OF THE INVENTION

An object of this invention is to provide a ferritic stainless steel exhibiting markedly improved corrosion resistance while retaining prominent properties inherent in ferritic stainless steel including good resistance to stress-corrosion cracking and inexpensiveness.

Another object is to provide an inexpensive ferritic stainless steel which can be used to manufacture articles which are mass-produced by way of press forming, the surface appearance of which is of primary importance and which is specially required to be kept rust-free for a prolonged period of time.

A further object is to provide a ferritic stainless steel corresponding to Mo-free, SUS 430 (AISI 430) series ferritic stainless steels, which can exhibit improved properties superior to those of Mo-containing SUS 434 (AISI 434) series ferritic stainless steels.

A still further object is to provide a ferritic stainless steel which is free from the defect that the metallic luster of the surface will easily be lost due to the formation of red rusts and corrosive pitting, which characterize ferritic stainless steels containing less than 20% of Cr.

SUMMARY OF THE INVENTION

Thus, this invention resides in a ferritic stainless steel exhibiting improved corrosion resistance, which comprises:

Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$ and the balance iron with incidental impurities, of which the amounts of carbon, nitrogen, phosphorous, sulfur and oxygen are as follows:

C: not greater than 0.05% by weight,
N: not greater than 0.05% by weight,
P: not greater than 0.05% by weight,
S: not greater than 0.002% by weight, and
O: not greater than 0.02% by weight.

A preferred composition of the ferritic stainless steel of this invention is:

Si: not greater than 0.5% by weight,
Mn: not greater than 0.5% by weight,
Cr: 15–18% or 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight,
P: not greater than 0.03% by weight,
S: not greater than 0.002%, preferably less than 0.001% by weight, and
O: not greater than 0.02% by weight.

If necessary, molybdenum in an amount of 0.10–4.00%, preferably 0.3–0.75% by weight, may be incorporated. The sulfur content is more preferably not greater than 0.0005% by weight.

This invention also resides in a ferritic stainless steel exhibiting improved corrosion resistance, which comprises:

Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$
at least one of 0.30–1.00% by weight of Cu and 0.20–2.00% by weight of Ni, and the balance iron with incidental impurities, of which the amounts of carbon, nitrogen, phosphorous sulfur and oxygen are as follows:
C: not greater than 0.05% by weight,
N: not greater than 0.05% by weight,
P: not greater than 0.05% by weight,
S: not greater than 0.005% by weight, and
O: not greater than 0.02% by weight.

A preferred composition of the ferritic stainless of this type is:

Si: not greater than 0.5% by weight,
Mn: not greater than 0.5% by weight,
Cr: 15–18% or 18.5–22.0% by weight,
Nb: 0.20–0.60% by weight wherein $Nb \geqq (8 \times C\% + 0.20\%)$,
at least one of 0.3–0.6% by weight of Cu and 0.2–0.6% by weight of Ni,
C: not greater than 0.025% by weight,
N: not greater than 0.025% by weight,
P: not greater than 0.03% by weight,
S: not greater than 0.002%, preferably less than 0.001% by weight, and
O: not greater than 0.02% by weight.

If necessary, molybdenum in an amount of 0.10–4.00%, preferably 0.3–0.75% by weight may be incorporated. The sulfur content is more preferably not greater than 0.0005% by weight.

DETAILED DESCRIPTION OF THE INVENTION

Figure 1:
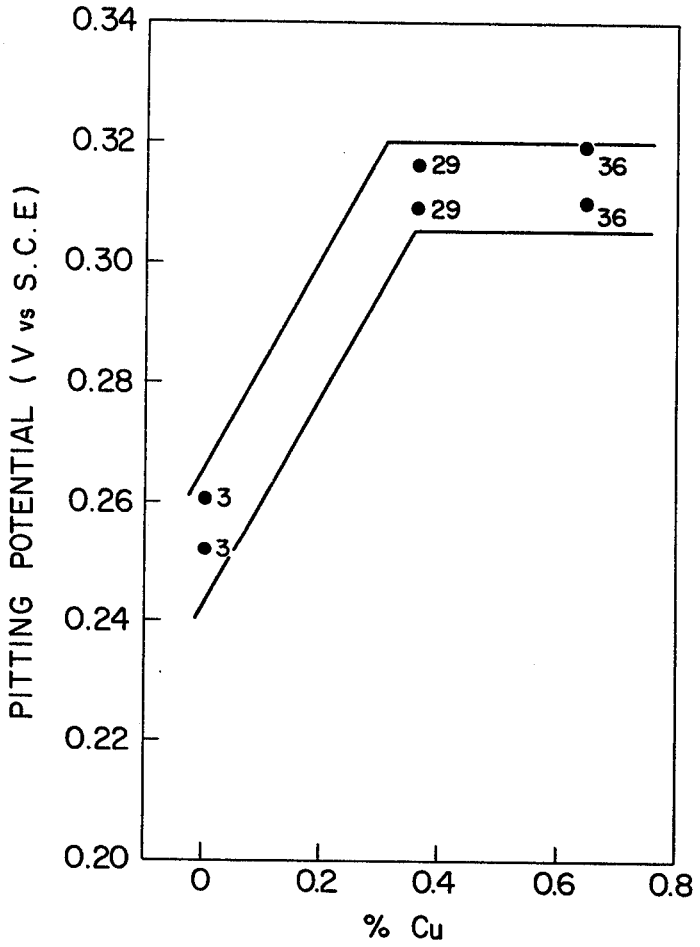
FIG. 1 is a graph showing the effect of copper content on pitting potential.

As is apparent from the above, this invention is characterized by the reduction in the amounts of sulfur and oxygen, which are present as impurities, to lower levels than ever commercially established in the art, in combination with the reduction in the amounts of carbon and nitrogen as well as the stabilization of the ferritic structure with the addition of niobium. Particularly, the content of sulfur is reduced to an ultra-low level, which is still further lower than the levels of the sulfur content found in low sulfur ferritic stainless steels. This is based on the findings of the inventors of this invention, and will be discussed in more detail hereinafter.

Thus, the ferritic stainless steel of this invention can exhibit an improved corrosion resistance over the conventional ferritic stainless steels containing expensive alloying elements, such as molybdenum, nickel, etc., even when the steel of the present invention does not contain these expensive elements. In addition, when at least one of molybdenum, nickel and copper is incorporated in the steel of this invention the corrosion resistance can markedly be improved and is comparable to that of certain austenitic stainless steels.

It is herein to be noted that according to this invention the reduction of sulfur content to an ultra-low level, i.e. not greater than 0.002%, generally less than 0.001%, or to not greater than 0.005% in cases where nickel and/or copper is added, results in unexpectedly advantageous effect on the improvement in corrosion resistance, and that this unexpected result can make clear the irrelevance of this invention to the general recognition in the prior art that the lower the sulfur content the better. This remarkable effect due to the reduction of the sulfur content to an ultra-low level was first found by the inventors of this invention during a series of experiments.

In another aspect, this invention is characterized by the intentional addition of copper and/or nickel, even though these elements are added sometimes in very small amounts. These elements have been thought to be eliminated from an alloy composition since experiments utilizing a boiling magnesium chloride shows that these elements have adverse effects on the resistance to stress-corrosion cracking. Therefore, though it has also been known in the art that the incorporation of copper and/or nickel can improve the resistance to non-oxidizing acids, such as HCl, the incorporation of these elements has been severely restricted due to their detrimental effects on the resistance of stress-corrosion cracking, which is of great importance to ferritic stainless steels. However, according to the findings of the inventors of this invention, as long as the composition of ferritic stainless steel falls within the range of this invention, the incorporation of not greater than 2.0% of Ni and/or not greater than 1.0% of Cu not only does not adversely affect the resistance to stress-corrosion cracking, but also can markedly improve the pitting corrosion resistance, interstitial corrosion resistance and resistance to rust. These effects are outstanding when the sulfur content is reduced to not greater than 0.005%, particularly to not greater than 0.002% in the Nb-stabilized ferritic stainless steel.

In addition, though, as in the case of SUS 434 (AISI 434), it is well known that molybdenum is added to improve the corrosion resistance of ferritic stainless steels, it has also been found that the addition of molybdenum to the ultra-low sulfur ferritic stainless steel of this invention further enhances the desired effect thereof.

Thus, according to this invention, a ferritic stainless steel can be provided, which exhibits not only markedly improved corrosion resistance as compared with the conventional ferritic stainless steel of the same series, but also good formability. In addition, since the steel of the present invention is an Nb-stabilized ferritic stainless steel, it is free from surface defects, such as streak flaws and white-cloudy appearance and can maintain good surface appearance for a prolonged period of time.

The reasons for defining the chemical composition of ferritic stainless steel of this invention as mentioned hereinbefore will be described:

(a) Silicon:

Silicon (Si) is added as an effective deoxidizing agent. The addition of silicon in an amount of less than 0.01% is not enough to achieve thorough deoxidization. However, when the silicon is over 5.0%, the formability deteriorates. The silicon content is restricted to within the range of 0.01 to 5.0%.

(b) Manganese:

Manganese (Mn) is effective to achieve desulfurization and deoxidization and also effective to improve hot workability. The addition of manganese in an amount of less than 0.01% is not enough for these purposes. On the other hand, the manganese in an amount of more than 5.0% does not provide any further improved effect. Therefore, the manganese content is restricted to within the range of 0.01 to 5.0%.

(c) Chromium:

Chromium (Cr) is a crucial element to provide the corrosion resistance essential to the steel of this invention. Therefore, from the standpoint of improving the corrosion resistance, it is desirable to increase the chromium content, and a steel having a chromium content of less than 8.0% cannot exhibit a thorough degree of corrosion resistance as stainless steel. However, an increase in chromium content of ferritic stainless steel leads to deterioration in some mechanical properties such as ductility and toughness, and at a chromium level exceeding 35.0% the brittleness of the ferritic stainless steel is so pronounced that offers problems during manufacturing of sheets, plates, pipes and other articles therefrom. Thus, according to the present invention, the chromium content is restricted to the range of 8.0 to 35.0%. Although the present steel contemplates a relatively wide range of chromium content as above, it is necessary in actual production thereof to select an appropriate chromium content by carefully considering material and manufacturing costs as well as various properties desired for the particular use of the steel. The present invention is primarily intended to provide an inexpensive ferritic stainless steel having good corrosion resistance along with good mechanical properties. More specifically, it is intended to develop substitutes for the SUS 434 (AISI 434) steel and SUS 304 (AISI 304) steel.

In a preferred embodiment of the invention, the chromium content is restricted to 15 to 18% and this embodiment provides an inexpensive ferritic stainless steel which can be substituted for the AISI Type 434 steel. In another preferred embodiment, the chromium content is restricted to a higher range of 18.5 to 22.0% and this embodiment provides a substitute for the AISI Type 304 steel which is the most widely used austenitic steel. The ferritic stainless steels of both these embodiments exhibit satisfactorily the desired properties as the respective substitute steels.

Of course, it is possible to vary not only the chromium content but the contents of other metallic elements such as Mo, Cu and Ni within the ranges defined in the appended claims to develop a new type steel of a novel composition. For this reason, the present invention has numerous possibilities.

(d) Niobium:

Niobium (Nb) is an effective element to fix carbon and nitrogen in steel so as to improve the resistance to rust as well as the resistance to the attack by acids, without impairing surface appearance of the steel. In addition, when a special manufacturing process, i.e. the manufacturing process in which the finishing temperature of hot rolling is restricted to not higher than 850° C. and the temperature for annealing prior to cold rolling is restricted to 950°-1050° C. (see Japanese Patent Application No. 25619/1980), is employed to produce a steel sheet, the crystal grains can be made fine to markedly improve formability and anisotropy in mechanical properties and simultaneously to effectively and significantly prevent the formation of ridges during press forming.

Thus, in order to achieve these purposes it is necessary to add niobium in an amount of 0.2% or more as well as in an amount of satisfying the equation: $Nb\% \geqq (C\% \times 8 + 0.2\%)$. This equation has been obtained by a series of experiments conducted to reveal the relationship between the carbon and niobium contents and mechanical and chemical properties of the ferritic stainless steel of this invention. However, when the proportion of niobium is over 1.0%, intermetallic compounds form and formability is impaired. Therefore, according to this invention the niobium content is defined as 0.2-1.0%, wherein $Nb\% \geqq (C\% \times 8 + 0.2\%)$.

The above mentioned four elements are essential to the ferritic stainless steel of this invention. The following elements, copper, nickel and molybdenum may be incorporated in the ferritic stainless steel of this invention, if desired. The reasons for defining these elements as in the above mentioned ranges will be discussed below.

(e) Copper:

Copper (Cu) is effective to improve the resistance to rust as well as the resistance to the attack by acids. The addition of copper also improves the resistance to pitting corrosion and interstitial corrosion as well as the formability of the resulting steel. Copper in an amount of less than 0.3% does not exhibit any improvement in these properties. However, when copper is over 1.0%, hot workability is impaired; in addition, the resistance to stress-corrosion cracking is also impaired. Therefore, this invention restricts the copper content, when it is intentionally added, to 0.3-1.0%.

FIG. 1 shows the relation between copper content and pitting potential, which was measured employing specimens obtained in the working examples hereinafter mentioned in more detail. The numerical references in the graph correspond to the specimen numbers in Table 1. The experiments were conducted as follows: Specimens were dipped in 0.01 M NaCl aqueous solution at 60° C. after the specimens were abraded with Emery paper #600. The pitting potential was measured in accordance with the Sweep method (20 mV/min) after deaerating with argon gas. The resulting data were arranged and evaluated in terms of $Vc'_{100}$ (i.e., the potential when the current density reached 100 uA/cm$^2$) ("n" number=2).

As is apparent from FIG. 1, the addition of copper raises pitting potential in proportion of the copper content, and the pitting potential becomes approximately constant after going up beyond the point of 0.3% of copper.

(f) Nickel:

Nickel (Ni) is also, like copper, effective to improve the resistance to rust as well as the resistance to the attack by acids. The addition of nickel also improves the resistance to pitting and interstitial corrosion. Nickel in an amount of less than 0.2% does not exhibit any improvement in these properties. However, nickel present in an amount of more than 2.0% would push the material cost up making the material expensive. Therefore, the nickel content is restricted to 0.2–2.0%, when it is intentionally added.

Figure 2:
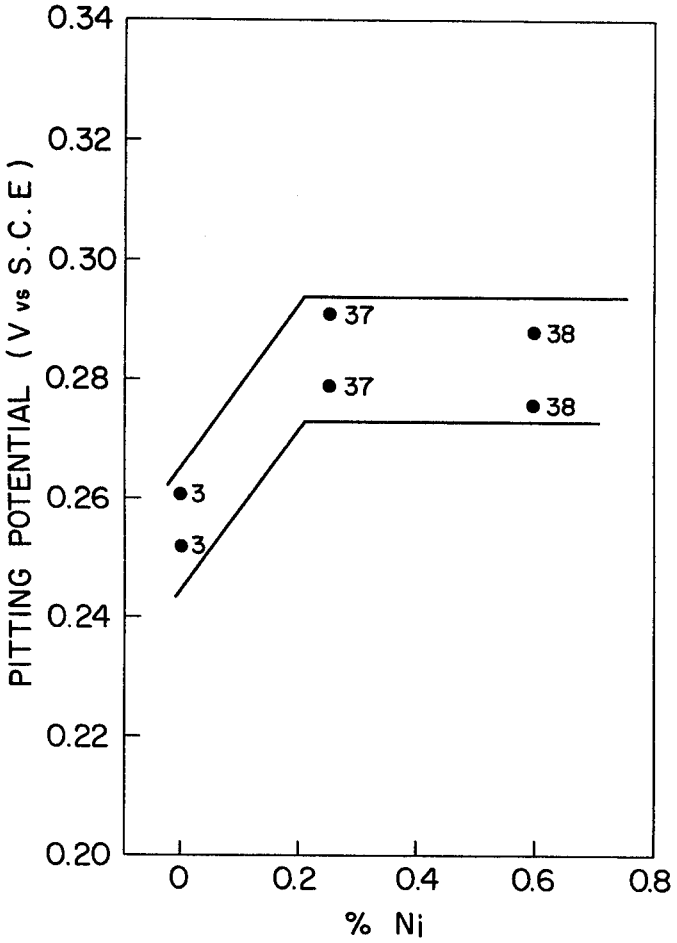
FIG. 2 is a graph showing the effect of nickel content on pitting potential.

FIG. 2 shows the relation between the nickel content and pitting potential, which was obtained in the same manner as in FIG. 1. The same tendency as in the case of copper can be observed.

(g) Molybdenum:

Molybdenum (Mo) is an effective additive to markedly improve the corrosion resistance of ferritic stainless steel. The addition of molybdenum is also effective to improve rusting resistance, acid resistance, interstitial resistance and pitting resistance. The addition of molybdenum in an amount of less than 0.1% does not achieve any improvement in these properties. On the other hand, the presence of molybdenum in an amount of more than 4.0% is not desirable from an economical viewpoint. Thus, this invention restricts the proportion of molybdenum, when it is intentionally added, to the range of 0.1 to 4.0%.

The following elements are treated as impurities in the ferritic stainless steel of this invention. However, as already stated, this invention in one aspect is characterized by restricting these impurities, since these impurities, in accordance to the findings of the inventors of this invention, play crucial roles in improving mechanical and chemical properties of ferritic stainless steel. The reasons for limiting these impurities as in this invention will be described below.

(h) Carbon and Nitrogen:

Carbon (C) and nitrogen (N) are elements having substantial adverse effect on the rusting resistance and acid resistance of ferritic stainless steel, particularly on those of a welded area. Carbon and nitrogen also have substantial adverse effect on toughness of the steel. It is, therefore, desirable to keep the contents of carbon and nitrogen as small as possible. Allowable upper limits of the amounts of carbon and nitrogen in this invention decrease as the content of chromium increases. For example, for a steel containing around 19% Cr the total amount of carbon and nitrogen is desirably less than 200 ppm and for a steel containing around 26% Cr it is desirably less than 100 ppm. Since this invention covers a steel containing chromium in an amount of as small as 8.0%, the upper limit of the amount each of carbon and nitrogen is defined as 0.05%. The reduction in amounts of carbon and nitrogen to these levels may contribute to improvement in formability of the steel.

(i) Phosphorous:

Phosphorous (P) is an element which impairs toughness. The presence of phosphorous as an impurity is limited to not greater than 0.05%. It is desirable to keep the amount of phosphorous in steel as low as possible.

(j) Oxygen:

Oxygen (O) present as an impurity in steel precipitates in the form of non-metallic inclusions of oxides, impairing the cleanness of the steel surface when the steel is worked into sheet. The precipitated inclusions also serve as starting points for rusting. In general, since the toughness of ferritic stainless steel is inferior to that of austenitic stainless steel which contains a relatively large amount of nickel, it is absolutely necessary to improve toughness in order to widen the application fields of ferritic stainless steel. The presence of oxygen has an adverse effect on toughness of ferritic stainless steel, and it is important to reduce the amount of oxygen in steel so as to improve the toughness. The lower the oxygen amount, the more desirable the resulting steel. Thus, the amount of oxygen in steel is limited to not greater than 0.02% in this invention. In order to reduce the oxygen amount to such a low level, not only deoxidization with an Si-Mn deoxidizing agent, but also deoxidization with an aluminium agent may be employed. When it is intended to reduce the amount of oxygen to a specially low level it is desirable to employ the deoxidization with the aluminium agent which is more effective than the Si-Mn agent. When the aluminium agent is used, aluminium in an amount of up to 0.2% may sometimes remains in the steel. The thus remaining aluminium is also included in impurities of this invention.

(k) Sulfur:

As already mentioned, one of the important factors of this invention, is to restrict the sulfur content to an ultra-low level, i.e. not greater than 0.002, generally less than 0.001% (10 ppm).

Figure 3:
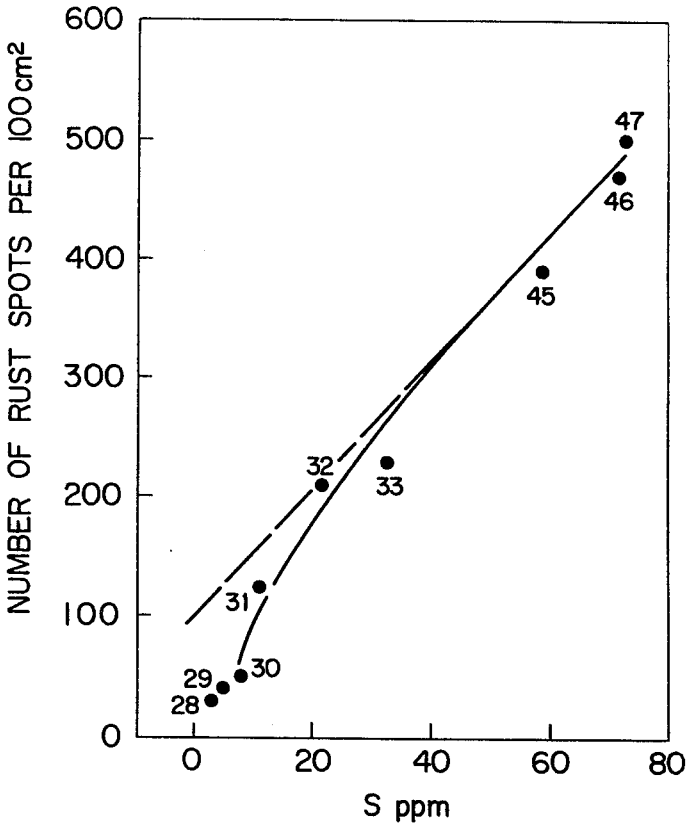
FIG. 3 is a graph showing illustrating the relation between sulfur content and the number of rust spots.

FIG. 3 is a graphical showing of the relation between the sulfur concentration in steel with the resistance to rust on the basis of the test results of the 400-cycle repeated dry-wet test utilizing an aqueous 5.0% NaCl solution (dipping for 25 minutes and drying for 5 minutes) at 50° C. The specimens were 2 mm (thickness)×30 mm (width)×70 mm (length) with roughly-buffed surfaces. It has been found that there is a close correlation between the sulfur content and the number of rust spots with a remarkable reduction in number of rust spots at a sulfur content of less than 0.0010%. The numerical references in the graph correspond to the specimen numbers in Table 1.

Figure 4:
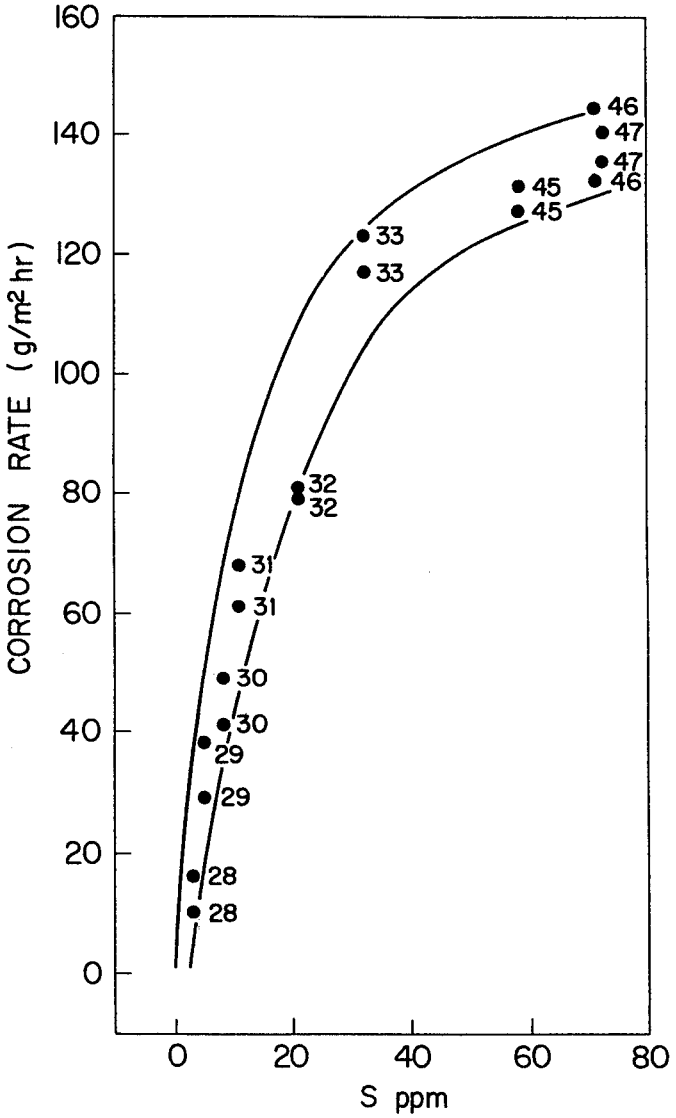
FIG. 4 is a graph showing the effect of sulfur content on the corrosion rate of a smaple dipped in a boiling hydrochloric acid.

FIG. 4 is a graphical showing of the test results of corrosion test in which specimens were dipped for 6 hours into a boiling hydrochloric acid solution at pH 1.4. The corrosion rates shown in the graph are mean values ("n" number=2). The specimens were 2 mm (thickness)×10 mm (width)×40 mm (length) with surfaces abraded (wet) with Emery paper #600. It is recognized from the graph that the corrosion rate is markedly reduced when the sulfur content is lowered to less than 0.0010%. The corrosion in cases where the sulfur content is not greater than 0.0005% (e.g. 0.0003%) is negligibly slight.

Figure 5:
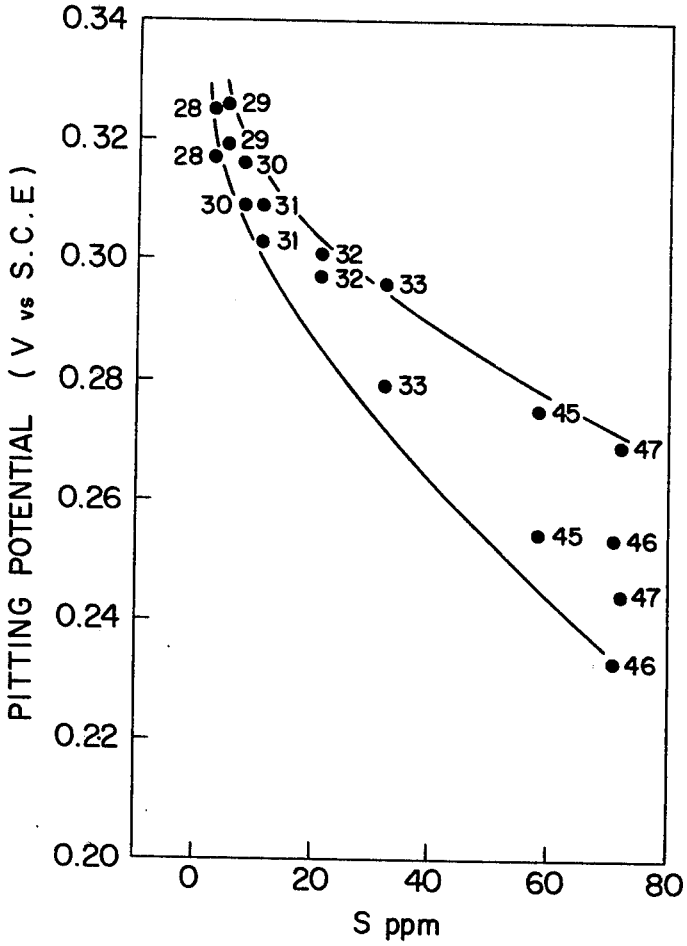
FIG. 5 is a graph showing the effect of sulfur content on pitting potential.

FIG. 5 graphically shows the relation between the sulfur content of the steel and pitting potential in 0.01 M NaCl aqueous solution at 60° C. The experimental procedures were the same as in case of FIGS. 1 and 2. It is recognized from FIG. 5 that the pitting potential increases as the sulfur amount decreases to an ultra-low level. Particularly, increase in pitting potential is remarkable at a sulfur content of less than 0.0010%. It is also noted that the pitting potential is evidently stabilized when the sulfur content goes down beyond the point of 0.0010%.

Theoretical analysis to explain why the corrosion resistance is unexpectedly and markedly improved when the sulfur content is less than 0.002%, generally less than 0.0010% has not yet been thoroughly conducted. However, it is to be noted that such an improved effect has experimentally been found in the Nb-containing ferritic stainless steel of this invention. In addition, as shown in FIGS. 3 through 5, it is in fact beyond theoretical observation or expectation that such unexpectedly improved results are obtained when the sulfur content goes down to as low as 0.0010%.

When copper and/or nickel are added intentionally, then the presence of sulfur in an amount of not greater than 0.005% may be allowed.

This invention will be further explained by way of working example.

EXAMPLE (1) Manufacturing process:

A series of sample steels having chemical compositions respectively shown in Table 1 below were prepared utilizing a vacuum refining furnace of the high-frequency induction heating type with a capacity of 2.5 tons and a vacuum melting furnace with a capacity of 20 Kg. The vacuum refining furnace is already installed in a factory production line and is provided with equipment for oxygen top-blowing and gas bottom-blowing and with a casting chamber for vacuum casting. In order to reduce the sulfur content to such an ultra-low level as in this invention, a flux agent carrying out desulfurization was blown against the melt surface during refining together with an argon carrier gas at a high velocity through a multi-nozzle lance. The flux agent was a Ca-Si flux agent. The powdered flux agent entrained in a carrier gas was blown against the melt surface at a high speed, and the melt was thereby agitated sufficiently to reduce the sulfur content to below 0.002%, or below 0.0010% (10 ppm).

The resulting ultra-low sulfur steel was vacuum cast into a 500 kg round ingot, which, after machining the surface skin, was hot worked into a 150 mm diameter round billet. The test specimens were prepared by cutting a portion weighing about 20 kg out of said round billet, applying hot forging to the cut-off blank to give a plate having the size of 30 mm (thickness)×130 mm (width)×length, and then applying hot rolling to provide a specimen having the shape of 3 mm (thickness)×130 mm (width)×length. The thus obtained specimens were annealed at a temperature of 1000° C. for 20 minutes and then either air-cooled or water quenched. The sulfur content in the steel was measured with an ultra-high performance sulfur analyzer manufactured by LECO Company (IR-32-SP). By utilizing this type of sulfur analyzer, the sulfur content in steel can be determined with a sensitivity of 0.1 ppm by way of the high-frequency combustion-infrared absorption system.

(2) Corrosion test:

A series of corrosion tests were carried out in the same manner as mentioned in connection with FIG. 1. The test results are summarized in Table 1 below.

In addition, the resistance to acids was determined on steels corresponding to 9% Cr-steels, 19% Cr-2% Mo-steels and 30% Cr-2% Mo-steels.

The test results and test conditions are summarized in Tables 2 through 4. The steel Nos. indicated are the same as in Table 1. In every grade of steel, the ferritic stainless steel of this invention is superior to comparative ones.

(3) Mechanical properties and ridging resistance:

Steel No. 29 and Steel No. 49 in Table 1 were selected as representative of the steel of this invention and a comparative steel, respectively, to produce cold rolled sheets 0.4 mm thick. On these steel sheets mechanical properties and ridging resistance were determined. The resulting test results are summarized in Table 5 together with manufacturing process conditions including hot rolling finishing temperature, conditions for annealing after hot rolling and conditions for annealing after cold rolling. The ridge formation was visually determined on the sheet surface after stretching 20% in tension, and the grade B in Table 5 corresponds to a ridge height of 16–25μ and the grade C' to 51–60μ.

It is apparent from the test results shown in Table 5, the cold rolled sheet of this invention steel exhibits markedly improved workability when the hot rolling finishing temperature is relatively low and the temperature for annealing after hot rolling is relatively high, and it also provides good ridging resistance.

TABLE 1

Composition (wt %) and corrosion resistance of sample steel

| Steel No. | | C | Si | Mn | P | S | Cr | Nb | O | N | Pitting potential $V'c_{100}$ (0.01M NaCl aq. 60° C., V vs SCE) | |
|---|---|---|---|---|---|---|---|---|---|---|---|---|
| This invention steel | 1 | 0.025 | 0.53 | 0.44 | 0.014 | 0.0006 | 8.97 | 0.58 | 0.008 | 0.027 | 0.032 | 0.028 |
| | 2 | 0.026 | 0.49 | 0.50 | 0.013 | 0.0011 | 9.06 | 0.59 | 0.010 | 0.024 | 0.018 | 0.013 |
| | 3 | 0.012 | 0.55 | 0.48 | 0.008 | 0.0005 | 16.52 | 0.58 | 0.006 | 0.021 | 0.252 | 0.261 |
| | 4 | 0.013 | 0.49 | 0.49 | 0.013 | 0.0004 | 16.73 | 0.57 | 0.005 | 0.016 | 0.255 | 0.259 |
| | 5 | 0.011 | 0.48 | 0.52 | 0.012 | 0.0012 | 16.82 | 0.58 | 0.008 | 0.017 | 0.240 | 0.243 |
| | 6 | 0.015 | 0.50 | 0.51 | 0.017 | 0.0014 | 16.66 | 0.59 | 0.009 | 0.018 | 0.241 | 0.239 |
| | 7 | 0.006 | 0.49 | 0.50 | 0.018 | 0.0006 | 19.63 | 0.57 | 0.007 | 0.013 | 0.304 | 0.307 |
| | 8 | 0.002 | 0.47 | 0.52 | 0.012 | 0.0005 | 19.87 | 0.58 | 0.005 | 0.014 | 0.306 | 0.312 |
| | 9 | 0.005 | 0.51 | 0.48 | 0.016 | 0.0013 | 20.02 | 0.60 | 0.008 | 0.013 | 0.289 | 0.292 |
| | 10 | 0.004 | 0.52 | 0.51 | 0.014 | 0.0015 | 19.77 | 0.59 | 0.008 | 0.013 | 0.293 | 0.287 |
| | 11 | 0.003 | 0.23 | 0.15 | 0.012 | 0.0008 | 26.56 | 0.49 | 0.007 | 0.005 | 0.511 | 0.518 |
| | 12 | 0.004 | 0.26 | 0.16 | 0.014 | 0.0012 | 27.89 | 0.50 | 0.006 | 0.004 | 0.520 | 0.516 |
| Comparative Steel | 13 | 0.025 | 0.50 | 0.46 | 0.013 | 0.0033 | 9.10 | 0.57 | 0.009 | 0.026 | −0.046 | −0.038 |
| | 14 | 0.023 | 0.52 | 0.48 | 0.015 | 0.0040 | 9.03 | 0.58 | 0.0012 | 0.022 | −0.052 | −0.048 |
| | 15 | 0.014 | 0.47 | 0.52 | 0.012 | 0.0052 | 16.62 | 0.57 | 0.005 | 0.017 | 0.178 | 0.182 |
| | 16 | 0.012 | 0.50 | 0.51 | 0.016 | 0.0058 | 16.55 | 0.59 | 0.008 | 0.018 | 0.183 | 0.188 |
| | 17 | 0.003 | 0.51 | 0.48 | 0.015 | 0.0062 | 19.88 | 0.58 | 0.007 | 0.016 | 0.239 | 0.241 |

TABLE 1-continued

Composition (wt %) and corrosion resistance of sample steel

| | | | | | | | | | | | | | |
|---|---|---|---|---|---|---|---|---|---|---|---|---|---|
| | 18 | 0.002 | 0.50 | 0.52 | 0.017 | 0.0055 | 19.99 | 0.59 | 0.009 | 0.015 | 0.233 | 0.228 |
| | 19 | 0.003 | 0.24 | 0.16 | 0.014 | 0.0062 | 26.89 | 0.47 | 0.006 | 0.005 | 0.449 | 0.439 |
| | 20 | 0.004 | 0.25 | 0.17 | 0.016 | 0.0059 | 27.03 | 0.48 | 0.007 | 0.004 | 0.451 | 0.447 |

| Steel No. | | C | Si | Mn | P | S | Cr | Mo | Nb | O | N | Pitting potential $V'c_{100}$ (0.01M NaCl aq. 60° C., V vs SCE) | |
|---|---|---|---|---|---|---|---|---|---|---|---|---|---|
| This invention steel | 21 | 0.006 | 0.54 | 0.48 | 0.016 | 0.0003 | 16.68 | 0.46 | 0.58 | 0.006 | 0.016 | 0.298 | 0.303 |
| | 22 | 0.006 | 0.51 | 0.50 | 0.010 | 0.0016 | 16.73 | 0.44 | 0.57 | 0.008 | 0.013 | 0.292 | 0.297 |
| | 23 | 0.007 | 0.48 | 0.49 | 0.009 | 0.0006 | 20.52 | 0.45 | 0.56 | 0.007 | 0.008 | 0.368 | 0.374 |
| | 24 | 0.003 | 0.53 | 0.52 | 0.012 | 0.0012 | 20.67 | 0.47 | 0.58 | 0.008 | 0.007 | 0.355 | 0.362 |
| Comparative steel | 25 | 0.008 | 0.52 | 0.50 | 0.010 | 0.0073 | 16.58 | 0.45 | 0.57 | 0.007 | 0.015 | 0.239 | 0.242 |
| | 26 | 0.004 | 0.46 | 0.48 | 0.008 | 0.0059 | 20.37 | 0.46 | 0.59 | 0.009 | 0.007 | 0.298 | 0.303 |

| Steel No. | | C | Si | Mn | P | S | Cu | Ni | Cr | Nb | O | N | Pitting potential $V'c_{100}$ (0.01M NaCl aq. 60° C., V vs SCE) | | Boiling HCl test (pH 1.4, 6hr g/m$^2$ hr) | | Wet-dry repeated test (No. of rust spots/ 100cm$^2$) |
|---|---|---|---|---|---|---|---|---|---|---|---|---|---|---|---|---|---|
| This invention steel | 27 | 0.022 | 0.51 | 0.46 | 0.012 | 0.0004 | 0.35 | 0.04 | 9.03 | 0.56 | 0.004 | 0.027 | 0.042 | 0.038 | — | — | — |
| | 28 | 0.014 | 0.51 | 0.47 | 0.003 | 0.0003 | 0.36 | 0.04 | 16.82 | 0.60 | 0.007 | 0.018 | 0.317 | 0.325 | 10.2 | 15.8 | 31 |
| | 29 | 0.011 | 0.57 | 0.50 | 0.008 | 0.0005 | 0.35 | 0.03 | 16.77 | 0.56 | 0.006 | 0.022 | 0.319 | 0.326 | 28.8 | 38.3 | 39 |
| | 30 | 0.012 | 0.52 | 0.49 | 0.004 | 0.0007 | 0.36 | 0.04 | 16.56 | 0.55 | 0.002 | 0.021 | 0.309 | 0.316 | 40.7 | 49.3 | 48 |
| | 31 | 0.013 | 0.55 | 0.48 | 0.020 | 0.0011 | 0.35 | 0.03 | 16.78 | 0.56 | 0.007 | 0.019 | 0.303 | 0.309 | 60.7 | 68.2 | 126 |
| | 32 | 0.016 | 0.53 | 0.50 | 0.018 | 0.0021 | 0.35 | 0.04 | 16.72 | 0.57 | 0.006 | 0.023 | 0.297 | 0.301 | 79.3 | 80.7 | 208 |
| | 33 | 0.018 | 0.56 | 0.52 | 0.023 | 0.0032 | 0.37 | 0.06 | 16.58 | 0.55 | 0.008 | 0.017 | 0.279 | 0.296 | 116.9 | 123.0 | 231 |
| | 34 | 0.002 | 0.60 | 0.51 | 0.020 | 0.0025 | 0.36 | 0.06 | 17.50 | 0.49 | 0.014 | 0.009 | 0.311 | 0.319 | 79.0 | 81.4 | 235 |
| | 35 | 0.002 | 0.59 | 0.49 | 0.019 | 0.0031 | 0.34 | 0.07 | 17.42 | 0.49 | 0.016 | 0.011 | 0.296 | 0.293 | 122.3 | 116.8 | 280 |
| | 36 | 0.013 | 0.55 | 0.48 | 0.010 | 0.0008 | 0.64 | 0.05 | 16.92 | 0.53 | 0.005 | 0.023 | 0.310 | 0.319 | <0.5 | <0.5 | — |
| | 37 | 0.003 | 0.53 | 0.50 | 0.009 | 0.0005 | 0.05 | 0.25 | 16.66 | 0.57 | 0.003 | 0.017 | 0.279 | 0.291 | 8.3 | 7.8 | — |
| | 38 | 0.010 | 0.51 | 0.49 | 0.006 | 0.0004 | 0.04 | 0.59 | 16.81 | 0.59 | 0.003 | 0.020 | 0.276 | 0.288 | <0.5 | <0.5 | — |
| | 39 | 0.006 | 0.56 | 0.51 | 0.023 | 0.0009 | 0.01 | 1.93 | 17.89 | 0.60 | 0.006 | 0.009 | 0.334 | 0.301 | <0.5 | <0.5 | — |
| | 40 | 0.008 | 0.52 | 0.48 | 0.007 | 0.0006 | 0.34 | 0.36 | 16.49 | 0.60 | 0.002 | 0.021 | 0.320 | 0.326 | <0.5 | <0.5 | 30 |
| | 41 | 0.005 | 0.23 | 0.31 | 0.004 | 0.0007 | 0.31 | 0.35 | 18.93 | 0.48 | 0.006 | 0.012 | 0.325 | 0.319 | <0.5 | <0.5 | 7 |
| | 42 | 0.006 | 0.23 | 0.31 | 0.004 | 0.0005 | 0.29 | 0.34 | 19.67 | 0.48 | 0.007 | 0.011 | 0.330 | 0.364 | <0.5 | <0.5 | 5 |
| | 43 | 0.004 | 0.24 | 0.31 | 0.004 | 0.0003 | 0.30 | 0.34 | 20.84 | 0.48 | 0.011 | 0.013 | 0.365 | 0.373 | <0.5 | <0.5 | 2 |
| Comparative steel | 44 | 0.027 | 0.53 | 0.46 | 0.018 | 0.0063 | 0.34 | 0.05 | 8.97 | 0.59 | 0.008 | 0.026 | 0.001 | −0.012 | — | — | — |
| | 45 | 0.012 | 0.55 | 0.49 | 0.019 | 0.0058 | 0.34 | 0.06 | 16.66 | 0.53 | 0.006 | 0.018 | 0.254 | 0.275 | 126.8 | 130.7 | 393 |
| | 46 | 0.014 | 0.51 | 0.47 | 0.022 | 0.0071 | 0.35 | 0.05 | 16.92 | 0.58 | 0.003 | 0.023 | 0.233 | 0.253 | 131.9 | 143.8 | 470 |
| | 47 | 0.017 | 0.59 | 0.50 | 0.025 | 0.0072 | 0.36 | 0.03 | 16.38 | 0.59 | 0.005 | 0.018 | 0.244 | 0.269 | 135.3 | 140.4 | 503 |
| | 48 | 0.005 | 0.60 | 0.50 | 0.020 | 0.0064 | 0.35 | 0.34 | 17.64 | 0.49 | 0.015 | 0.008 | 0.273 | 0.255 | 138.0 | 141.3 | 398 |
| | 49 | 0.052 | 0.59 | 0.48 | 0.027 | 0.0071 | 0.12 | 0.14 | 16.75 | — | 0.008 | 0.025 | 0.200 | 0.189 | 148.8 | 152.3 | numerous red rust spots |
| | 50 | 0.061 | 0.56 | 1.52 | 0.030 | 0.0078 | 0.22 | 9.32 | 18.72 | — | — | — | 0.356 | 0.373 | — | — | — |

| Steel No. | | C | Si | Mn | P | S | Cu | Ni | Cr | Mo | Nb | O | N | Pitting potential $V'c_{100}$ (0.01M NaCl aq. 60° C., V vs SCE) | | Boiling HCl Test (pH 1.4, 6hr g/m$^2$ hr) | | Wet-dry repeated test (No. of rust spots/100 cm$^2$ |
|---|---|---|---|---|---|---|---|---|---|---|---|---|---|---|---|---|---|---|
| This invention steel | 51 | 0.009 | 0.58 | 0.49 | 0.017 | 0.0016 | 0.35 | 0.05 | 17.64 | 0.44 | 0.49 | 0.012 | 0.019 | 0.339 | 0.331 | <0.5 | <0.5 | — |
| | 52 | 0.012 | 0.53 | 0.47 | 0.005 | 0.0003 | 0.35 | 0.05 | 16.72 | 0.44 | 0.44 | 0.006 | 0.018 | 0.343 | 0.348 | <0.5 | <0.5 | 13 |
| | 53 | 0.006 | 0.23 | 0.31 | 0.004 | 0.0003 | 0.31 | 0.36 | 18.76 | 0.48 | 0.48 | 0.007 | 0.012 | 0.352 | 0.348 | <0.2 | <0.2 | 4 |
| | 54 | 0.006 | 0.23 | 0.31 | 0.004 | 0.0006 | 0.30 | 0.35 | 19.79 | 0.45 | 0.45 | 0.011 | 0.011 | 0.365 | 0.363 | <0.2 | <0.2 | 3 |
| | 55 | 0.007 | 0.24 | 0.31 | 0.004 | 0.0005 | 0.30 | 0.37 | 20.79 | 0.46 | 0.46 | 0.007 | 0.008 | 0.382 | 0.375 | <0.2 | <0.2 | 4 |
| | 56 | 0.005 | 0.14 | 0.12 | 0.005 | 0.0005 | 0.16 | 0.22 | 19.12 | 2.10 | 0.43 | 0.005 | 0.006 | 0.442 | 0.446 | — | — | — |
| | 57 | 0.003 | 0.14 | 0.14 | 0.008 | 0.0005 | 0.08 | 0.22 | 30.21 | 1.98 | 0.29 | 0.008 | 0.004 | — | — | — | — | — |
| Comparative steel | 58 | 0.010 | 0.58 | 0.49 | 0.020 | 0.0062 | 0.35 | 0.06 | 17.56 | 0.44 | 0.49 | 0.018 | 0.010 | 0.280 | 0.276 | 136.4 | 135.5 | 358 |
| | 59 | 0.006 | 0.24 | 0.30 | 0.004 | 0.0064 | 0.30 | 0.35 | 20.02 | 0.46 | 0.48 | 0.006 | 0.0011 | 0.318 | 0.327 | 86.3 | 85.1 | 26 |
| | 60 | 0.005 | 0.15 | 0.18 | 0.009 | 0.0072 | 0.15 | 0.08 | 19.10 | 2.02 | 0.46 | 0.004 | 0.007 | 0.408 | 0.415 | — | — | — |
| | 61 | 0.003 | 0.16 | 0.13 | 0.010 | 0.0067 | 0.10 | 0.12 | 30.23 | 2.08 | 0.33 | 0.007 | 0.005 | — | — | — | — | — |
| | 62 | 0.069 | 0.55 | 1.47 | 0.032 | 0.0100 | 0.07 | 13.06 | 16.89 | 2.13 | — | — | — | 0.468 | 0.489 | — | — | — |
| | 63 | 0.017 | 0.53 | 1.70 | 0.028 | 0.0070 | 0.18 | 11.25 | 18.35 | — | — | — | — | 0.355 | 0.369 | — | — | — |
| | 64 | 0.021 | 0.51 | 1.45 | 0.029 | 0.0080 | 0.09 | 13.75 | 16.25 | 2.11 | — | — | — | 0.453 | 0.492 | — | — | — |
| | 65 | 0.053 | 0.48 | 0.56 | 0.026 | 0.0091 | 0.01 | 0.16 | 16.31 | 0.97 | — | — | — | 0.225 | 0.210 | — | — | — |

TABLE 2

The resistance of 9% Cr steel to acids (g/m$^2$ hr) at room temperature for 6 hours

| Steel No. | | 10% $HNO_3$ | 10% $H_2SO_4$ | 10% HCl |
|---|---|---|---|---|
| Invention | 27 | 0.63 | 0.81 | 0.34 |
| Comparative | 44 | 1.22 | 1.43 | 0.79 |

TABLE 3

The resistance of 19% Cr—2% Mo steel to acids (g/m$^2$ hr) at boiling temperature for 6 hours

| Steel No. | | 65% $HNO_3$ | 0.5% $H_2SO_4$ | 0.5% HCl |
|---|---|---|---|---|
| Invention | 56 | <0.1 | <0.1 | <0.1 |
| Comparative | 60 | 0.21 | 91 | 153 |
| | 50* | 0.25 | 1.54 | 3.22 |

TABLE 3-continued

| The resistance of 19% Cr—2% Mo steel to acids ($g/m^2$ hr) at boiling temperature for 6 hours | | | |
|---|---|---|---|
| Steel No. | 65% $HNO_3$ | 0.5% $H_2SO_4$ | 0.5% HCl |
| 62** | 0.28 | <0.1 | 4.01 |

*A steel corresponding to AISI Type 304.
**A steel corresponding to AISI Type 316.

TABLE 4

| The resistance of 30% Cr—2% Mo steel to acids ($g/m^2$ hr) at boiling temperature for 6 hours | | | | |
|---|---|---|---|---|
| Steel No. | | 65% $HNO_3$ | 5% $H_2SO_4$ | 1% HCl |
| Invention | 57 | <0.01 | 0.12 | 0.22 |
| Comparative | 61 | 0.016 | 0.40 | 0.61 |
| | 63* | 0.138 | 185.7 | 13.31 |
| | 64** | 0.029 | 4.98 | 16.22 |

*A steel corresponding to AISI Type 304L.
**A steel corresponding to AISI Type 316L.

TABLE 5

| Steel No. | Manufacturing process conditions: Hot rolling finishing temp. (°C.) | Temp. for annealing after hot rolling (°C.) | Temp. for annealing after cold rolling (°C.) | Mechanical properties (formability): Yp ($kg/mm^2$) | Ts ($kg/mm^2$) | El (%) | $\bar{r}$ | $\bar{n}$ | CCV (36φ) | Er (mm) | λ (%) | Ridging resistance (20% in tension) |
|---|---|---|---|---|---|---|---|---|---|---|---|---|
| 29 | 780 | 1000° C. × 1min A.C | 950° C. × 1min A.C | 34.7 | 52.9 | 31.2 | 1.95 | 0.19 | 27.8 | 9.63 | 89.5 | B |
| 29 | 880 | 830° C. × 16hr A.C | 830° C. × 1min A.C | 35.1 | 54.2 | 28.5 | 1.41 | 0.18 | 28.2 | 9.53 | 65.3 | C' |
| 49* | 880 | 830° C. × 16hr A.C | 830° C. × 1min A.C | 40.0 | 58.4 | 26.6 | 1.19 | 0.14 | 28.7 | 9.50 | 45.1 | B |

*A steel corresponding to AISI Type 430.

Thus, as is apparent from the foregoing, the ferritic stainless steel of this invention, even when nickel, copper or molybdenum is not added intentionally, can exhibit good corrosion resistance superior to that of the SUS 434 (AISI 434) steel which contains molybdenum. In addition, the ferritic stainless steel of this invention, when it contains at least one of nickel, copper and molybdenum in small amounts can exhibit satisfactory corrosion resistance comparable to that of certain austenitic stainless steels. Furthermore, since the steel of this invention is available in the form of steel sheet exhibiting not only good formability, but also good surface appearance, it is of a great value as an industrial material from a practical viewpoint.

What is claimed is:

1. A ferritic stainless steel exhibiting improved corrosion resistance, which consists essentially of:

Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$ and the balance iron with incidental impurities of which the amounts of carbon, nitrogen, phosphorous, sulfur and oxygen are as follows:
C: not greater than 0.05% by weight,
N: not greater than 0.05% by weight,
P: not greater than 0.05% by weight,
S: not greater than 0.002% by weight, and
O: not greater than 0.02% by weight.

2. A ferritic stainless steel as defined in claim 1, in which sulfur is less than 0.001% by weight.

3. A ferritic stainless steel as defined in claim 1 or 2, in which

Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

4. A ferritic stainless steel as defined in claim 1 or 2, in which

Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

5. A ferritic stainless steel exhibiting improved corrosion resistance, which consists essentially of:

Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$,
Mo: 0.10–4.00% by weight,
and the balance iron with incidental impurities of which the amounts of carbon, nitrogen, phosphorous, sulfur and oxygen are as follows:
C: not greater than 0.05% by weight,
N: not greater than 0.05% by weight,
P: not greater than 0.05% by weight,
S: not greater than 0.002% by weight, and
O: not greater than 0.02% by weight.

6. A ferritic stainless steel as defined in claim 5, in which sulfur is less than 0.001% by weight.

7. A ferritic stainless steel as defined in claim 5 or 6, in which molybdenum is present in an amount of 0.3–0.75% by weight.

8. A ferritic stainless steel as defined in claim 5 or 6, in which

Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$
C: not greater than 0.025% by weight,
N: not greater than 0.025% by weight, and
P: not greater than 0.03% by weight.

9. A ferritic stainless steel as defined in claim 5 or 6, in which

Si: not greater than 0.5% by weight,
Mn: not greater than 0.5% by weight,
Cr: 18.5–22.0% by weight, Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

10. A ferritic stainless steel exhibiting improved corrosion resistance, which consists essentially of:
Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$
at least one of 0.30–1.00% by weight of Cu and 0.20–2.00% by weight of Ni, and the balance iron with incidental impurities of which the amounts of carbon, nitrogen, phosphorous, sulfur and oxygen are as follows:
C: not greater than 0.05% by weight,
N: not greater than 0.05% by weight,
P: not greater than 0.05% by weight,
S: not greater than 0.002% by weight, and
O: not greater than 0.02% by weight.

11. A ferritic stainless steel as defined in claim 10, in which sulfur is less than 0.001% by weight.

12. A ferritic stainless steel as defined in claim 10 or 11, in which
Cu: 0.3–0.6% by weight, and
Ni: 0.2–0.6% by weight.

13. A ferritic stainless steel as defined in claim 10 or 11, in which
Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

14. A ferritic stainless steel as defined in claim 10 or 11, in which
Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

15. A ferritic stainless steel exhibiting improved corrosion resistance, which consists essentially of:
Si: 0.01–5.00% by weight,
Mn: 0.01–5.00% by weight,
Cr: 8.0–35.0% by weight,
Nb: 0.20–1.00% by weight wherein $Nb \geqq (8 \times C\% + 0.20\%)$,
Mo: 0.10–4.00% by weight,
at least one of 0.30–1.00% by weight of Cu and 0.20–2.00% by weight of Ni, and the balance iron with incidental impurities of which the amounts of carbon, nitrogen, phosphorous, sulfur and oxygen are as follows:
C: not greater than 0.05% by weight,
N: not greater than 0.05% by weight,
P: not greater than 0.05% by weight,
S: not greater than 0.002% by weight, and
O: not greater than 0.02% by weight.

16. A ferritic stainless steel as defined in claim 15, in which sulfur is less than 0.001% by weight.

17. A ferritic stainless steel as defined in claim 15 or 18 in which
Mo: 0.3–0.75% by weight,
Cu: 0.3–0.6% by weight, and
Ni: 0.2–0.6% by weight.

18. A ferritic stainless steel as defined in claim 15 or 16, in which
Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

19. A ferritic stainless steel as defined in claim 15 or 16, in which
Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

20. A ferritic stainless steel as defined in claim 7, in which
Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

21. A ferritic stainless steel as defined in claim 7, in which
Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

22. A ferritic stainless steel as defined in claim 12, in which
Si: not greater than 0.5% by weight,
Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

23. A ferritic stainless steel as defined in claim 12, in which
Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

24. A ferritic stainless steel as defined in claim 17, in which
Si: not greater than 0.5% by weight, Mn: not greater than 0.5% by weight,
Cr: 15–18% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

25. A ferritic stainless steel as defined in claim 17, in which

Si: not greater than 0.5% by weight,
Mn: not greater than 0.5% by weight,
Cr: 18.5–22.0% by weight,
Nb: 0.20–0.60% by weight wherein $Nb \geqq (8 \times C\% + 0.20\%)$,
C: not greater than 0.025% by weight,
N: not greater than 0.025% by weight, and
P: not greater than 0.03% by weight.

* * * * *